US009956472B2

(12) United States Patent
Sugata

(10) Patent No.: US 9,956,472 B2
(45) Date of Patent: May 1, 2018

(54) STANDING-RIDE TYPE MOVING DEVICE

(71) Applicant: TOYOTA JIDOSHA KABUSHIKI KAISHA, Toyota-shi, Aichi-ken (JP)

(72) Inventor: Hikaru Sugata, Miyoshi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days. days.

(21) Appl. No.: 15/462,109

(22) Filed: Mar. 17, 2017

(65) Prior Publication Data

US 2017/0274271 A1 Sep. 28, 2017

(30) Foreign Application Priority Data

Mar. 24, 2016 (JP) ..... 2016-060665

(51) Int. Cl.
*A63C 17/12* (2006.01)
*A63C 17/01* (2006.01)

(52) U.S. Cl.
CPC ..... *A63C 17/011* (2013.01); *A63C 17/013* (2013.01); *A63C 17/015* (2013.01); *A63C 17/12* (2013.01); *A63C 2203/12* (2013.01); *A63C 2203/18* (2013.01); *A63C 2203/40* (2013.01); *A63C 2203/52* (2013.01)

(58) Field of Classification Search
CPC ..... A63C 17/01; A63C 17/26; A63C 6/08; A63C 3/00; A63B 7/08; A63B 22/14; G10H 3/00
See application file for complete search history.

(56) References Cited

U.S. PATENT DOCUMENTS

2013/0206493 A1* 8/2013 Larson ..... A63C 17/12 180/181
2015/0045178 A1* 2/2015 Chan ..... B60W 10/08 477/4

FOREIGN PATENT DOCUMENTS

JP 09-010375 A 1/1997
JP 2006-192078 A 7/2006

* cited by examiner

*Primary Examiner* — Bryan A Evans
(74) *Attorney, Agent, or Firm* — Sughrue Mion, PLLC

(57) ABSTRACT

A standing-ride type moving device includes: a board; wheels that are disposed on right and left sides of a front side and a rear side in a traveling direction of the board; drive units that is configured to independently rotationally drive the wheels disposed on the front side in the traveling direction of the board; a first sensor that is configured to detect a shift in the center of gravity of the rider riding the board; a steering board that is disposed on the front side in the traveling direction of the board; a second sensor that that is configured to acquire rotation information of the steering board; and a control unit that is configured to control the drive units.

9 Claims, 13 Drawing Sheets

STANDING-RIDE TYPE MOVING DEVICE

INCORPORATION BY REFERENCE

The disclosure of Japanese Patent Application No. 2016-060665 filed on Mar. 24, 2016 including the specification, drawings and abstract is incorporated herein by reference in its entirety.

BACKGROUND

1. Technical Field

The disclosure relates to a standing-ride type moving device.

2. Description of Related Art

Recently, personal mobility for assisting people with movement has been researched and developed. Japanese Patent Application Publication No. H9-010375 (JP H9-010375 A) discloses a technique of a self-propelled roller board having a drive unit mounted thereon. The self-propelled roller board disclosed in JP H9-010375 A is configured to control stopping, forward movement, backward movement, and the like depending on weight shift of a rider.

SUMMARY

In the self-propelled roller board disclosed in JP H9-010375 A, pressure sensors are disposed in a front part and a rear part of the self-propelled roller board and the drive unit mounted on the self-propelled roller board is controlled on the basis of the pressure detected by the pressure sensors. A turning control board which is mechanically connected to front wheels is disposed in a front part of the self-propelled roller board. A traveling direction of the self-propelled roller board is changed when a rider rotates the turning control board with his or her feet to change the direction of the front wheels.

However, in the self-propelled roller board disclosed in JP H9-010375 A, since the wheels are mechanically connected to the turning control board, a level difference or an inclination of a road surface is transmitted to the rider's feet via the wheels and the turning control board. Accordingly, there is concern of the rider of the self-propelled roller board losing body balance. For example, when the self-propelled roller board travels on a rough road, resistance between the road surface and the wheels increases and thus the rider feels that the turning control board is heavier when the rider rotates the turning control board. Accordingly, there is a possibility of the rider losing body balance and having an unstable posture when the rider rotates the turning control board.

The disclosure provides a standing-ride type moving device that can stabilize a rider's posture.

According to an aspect of the disclosure, there is provided a standing-ride type moving device including: a board that a rider rides; wheels that are disposed on right and left sides of a front side and a rear side in a traveling direction of the board; a first drive unit that is configured to independently rotationally drive the wheel disposed on the right side in the traveling direction of the board on at least one of the front side and the rear side in the traveling direction of the board; a second drive unit that is configured to independently rotationally drive the wheel disposed on the left side in the traveling direction of the board to correspond to the wheel rotationally driven by the first drive unit; a first sensor that is configured to detect a shift in a center of gravity of the rider riding the board; a steering board that is disposed on at least one of the front side and the rear side in the traveling direction of the board and is rotatable about a rotational axis extending in a vertical direction; a second sensor that is configured to acquire rotation information of the steering board; and a control unit that is configured to control the first and second drive units. In addition to a strictly vertical direction, "vertical direction" mentioned herein includes the concept of a "substantially vertical direction" that can be considered to be a vertical direction when viewed in light of common general technical knowledge. The control unit controls rotation speeds of the first and second drive units based on the shift in the center of gravity of the rider detected by the first sensor to control a speed in the traveling direction of the board and turns the board in a direction corresponding to the rotation information by independently controlling the rotation speeds of the first and second drive units based on the rotation information acquired by the second sensor.

In the aspect of the disclosure, the board is turned in the direction corresponding to the rotation information by independently controlling the rotation speeds of the first and second drive units based on the rotation information of the steering board acquired by the second sensor (a rotation sensor). In the standing-ride type moving device according to the disclosure having this configuration, since the steering board and the wheels are not mechanically connected to each other, it is possible to prevent a level difference or an inclination of a road surface from being transmitted to the rider's feet. Since the rotation information of the steering board is acquired using the second sensor (the rotation sensor) and the first and second drive units are controlled using the rotation information, the steering board does not become heavy even during travel on a rough road. Accordingly, it is possible to prevent the rider from losing body balance. As a result, it is possible to provide a standing-ride type moving device that can stabilize a rider's posture.

In the aspect of the disclosure, the control unit may control the first and second drive units such that a turning radius of the board in which the board is turned increases as the rotation speeds of the first and second drive units increase.

In this way, by setting the turning radius of the board in which the board is turned to increase as the rotation speeds of the first and second drive units increase, that is, as the speed of the board increases, it is possible to prevent the rider from being shaken off the board due to the centrifugal force at the time of turning.

In the aspect of the disclosure, the control unit may control the first and second drive units such that the turning radius of the board in which the board is turned decreases as the rotation speeds of the first and second drive units decrease.

In the aspect of the disclosure, the control unit may control the first and second drive units such that the turning radius of the board in which the board is turned linearly varies with respect to the rotation information of the steering board acquired by the second sensor when the rotation speeds of the first and second drive units are lower than a predetermined rotation speed.

Through this control, since the turning radius of the board varies linearly with respect to the rotation information of the steering board, the rider can intuitively turn the board in a predetermined direction.

In the aspect of the disclosure, the standing-ride type moving device may further include a rectangular frame that is disposed between the board and the wheels, and the first sensor may be disposed at four corners of the frame to be interposed between the frame and the board.

In the aspect of the disclosure, the board may include a recessed portion in which the steering board is rotatably disposed.

In the aspect of the disclosure, the second sensor may be a rotation angle sensor.

In the aspect of the disclosure, the second sensor may be a torque sensor.

In the aspect of the disclosure, the first sensor may be a multiaxial sensor that is disposed at a center of the board.

According to the disclosure, it is possible to provide a standing-ride type moving device that can stabilize a rider's posture.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
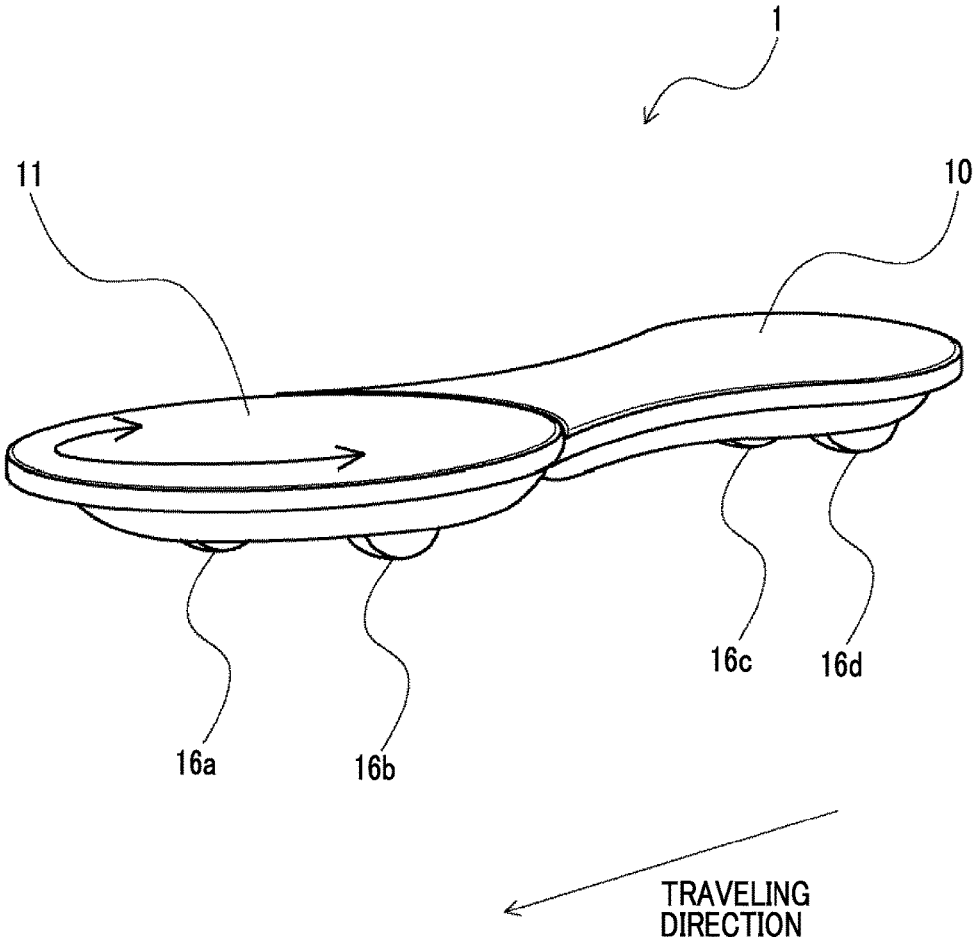
FIG. 1 is a perspective view illustrating a standing-ride type moving device according to an embodiment.

Hereinafter, an embodiment will be described with reference to the accompanying drawings. FIG. 1 is a perspective view illustrating a standing-ride type moving device according to the embodiment. As illustrated in FIG. 1, the standing-ride type moving device 1 according to the embodiment includes a board 10, a steering board 11, and wheels 16*a* to 16*d*.

The board 10 is formed of a plate-shaped member having a flat surface and a rider boards the top surface of the board 10. The steering board 11 is disposed on the front side in the traveling direction of the board 10. In this specification, it is assumed that the board 10 includes the steering board 11 and "a rider boards the board 10" means that the rider boards the top surface of the board 10 and the steering board 11. Specifically, this refers to a state in which one foot of the rider is located on the top surface of the board 10 and the other foot is located on the top surface of the steering board 11 (see FIG. 2). The wheels 16*a* to 16*d* are disposed on the right and left sides of the front side and the rear side of the board 10.

Figure 2:
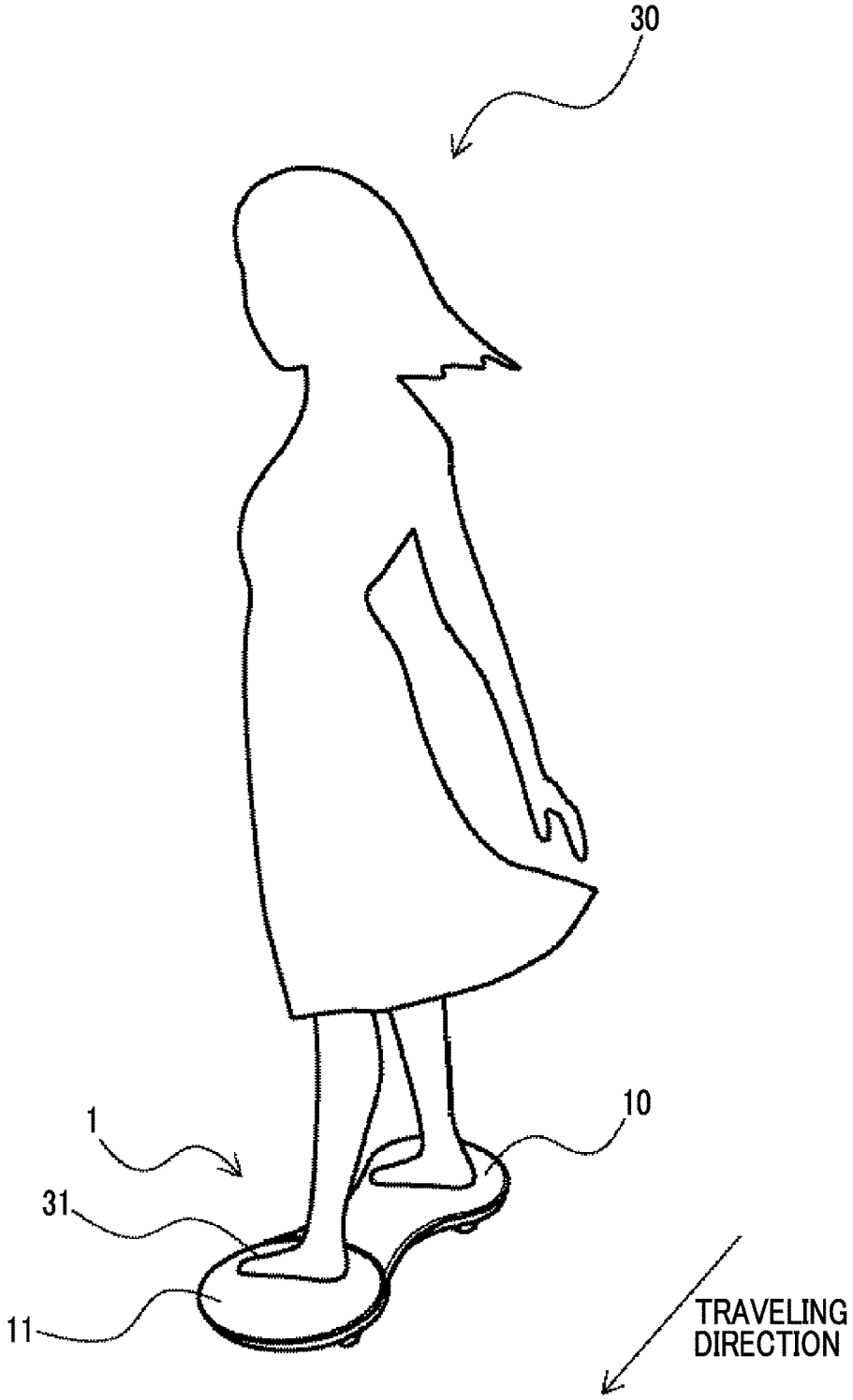
FIG. 2 is a diagram illustrating a use example of the standing-ride type moving device according to the embodiment.

FIG. 2 is a diagram illustrating a use example of the standing-ride type moving device according to this embodiment. A speed of the standing-ride type moving device 1 according to this embodiment can be adjusted depending on a shift in the center of gravity (in other words, weight shift of a rider) in the front-rear direction of a rider 30 riding the board 10. The rider 30 riding the board 10 can turn the board 10 (the standing-ride type moving device 1) by rotating the steering board 11 with his or her foot 31 (the left foot in FIG. 2).

Figure 3:
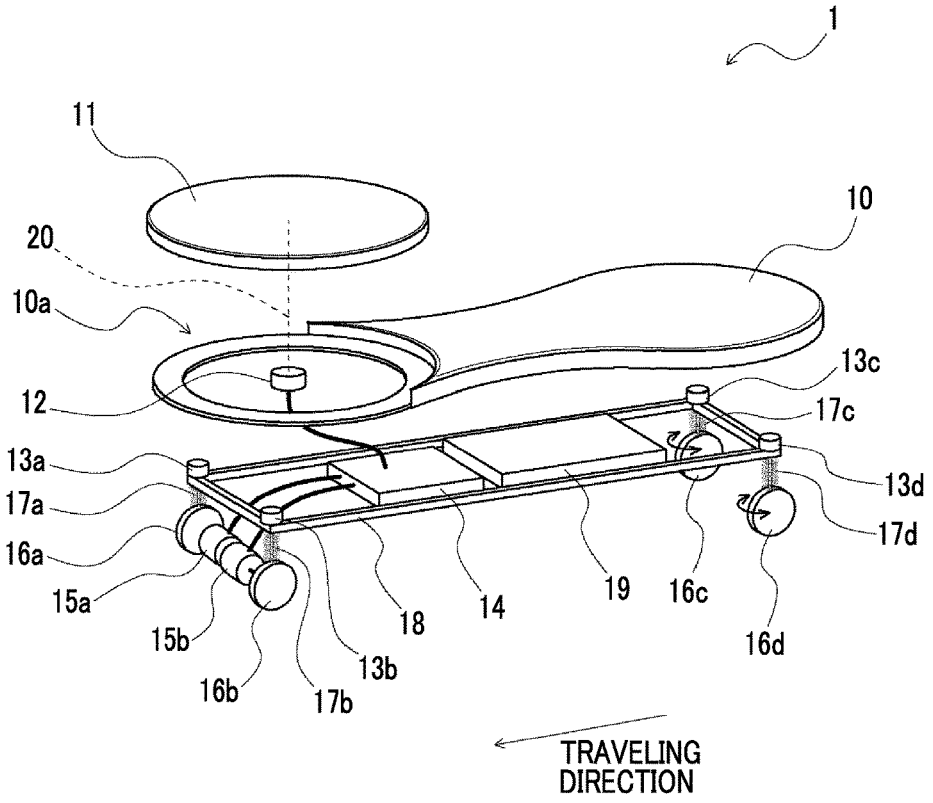
FIG. 3 is an exploded perspective view illustrating the standing-ride type moving device according to the embodiment.

The detailed configuration of the standing-ride type moving device 1 according to the embodiment will be described below with reference to the exploded perspective view illustrated in FIG. 3. As illustrated in FIG. 3, the standing-ride type moving device 1 includes the board 10, the steering board 11, a rotation sensor (a second sensor) 12, load sensors (a first sensor) 13*a* to 13*d*, a control unit 14, drive units 15*a* and 15*b*, the wheels 16*a* to 16*d*, suspensions 17*a* to 17*d*, a frame 18, and a battery 19.

The frame 18 is rectangular and can be made of, for example, a metal material. The wheels 16*a* to 16*d* are disposed below four corners of the frame 18. The suspensions 17*a* to 17*d* are disposed between the wheels 16*a* to 16*d* and the frame 18. By disposing the suspensions 17*a* to 17*d*, it is possible to suppress vibration transmitted from a road surface to the wheels 16*a* to 16*d* from being transmitted to the frame 18. In the standing-ride type moving device 1 illustrated in FIG. 3, the wheels 16*a* and 16*b* are front wheels and the wheels 16*c* and 16*d* are rear wheels.

The wheels 16*a* and 16*b* are provided with the drive units 15*a* and 15*b* that independently rotationally drive the wheels 16*a* and 16*b*, respectively. The drive units 15*a* and 15*b* can be constituted, for example, using a motor. Casters that are rotatable about a rotational axis parallel to a vertical direction can be used as the wheels 16*c* and 16*d*. That is, in the standing-ride type moving device 1 according to the embodiment, the wheels 16*a* and 16*b* are configured to be independently driven using the drive units 15*a* and 15*b*, and the wheels 16*c* and 16*d* are configured using the casters. Accordingly, by controlling the rotation speeds of the drive units 15*a* and 15*b* to be different from each other, the board 10 (the standing-ride type moving device 1) can be turned right and left.

Specifically, by controlling the rotation speed of the drive unit 15*a* (the wheel 16*a*) to be higher than the rotation speed of the drive unit 15*b* (the wheel 16*b*), the board 10 can be turned left. By controlling the rotation speed of the drive unit 15*b* (the wheel 16*b*) to be higher than the rotation speed of the drive unit 15*a* (the wheel 16*a*), the board 10 can be turned right.

A reduction gear may be attached to the wheels 16*a* and 16*b*. For example, the reduction gear can be constituted using a planetary gear. The control unit 14 and the battery 19 are attached to the frame 18. The battery 19 supplies power to the control unit 14 and the drive units 15*a* and 15*b*. For example, a lithium ion secondary battery can be used as the battery 19.

The load sensors 13*a* to 13*d* are disposed at four corners of the frame 18. That is, when the board 10 is attached to the frame 18, a load of a rider riding the board 10 can be detected by interposing the load sensors 13*a* to 13*d* between the frame 18 and the board 10. In other words, a shift in the center of gravity (weight shift) of the rider can be detected using the load sensors 13*a* to 13*d*. For example, a sensor using a piezoelectric element or a sensor using a strain gauge can be used as the load sensors 13*a* to 13*d*. Signals detected by the load sensors 13*a* to 13*d* are supplied to the control unit 14.

The board 10 is attached to the top of the frame 18. The steering board 11 is disposed on the front side in the traveling direction of the board 10 to be rotatable about a rotational axis 20 extending in the vertical direction. That is, a recessed portion 10*a* having a shape corresponding to the steering board 11 is formed on the front side in the traveling direction of the board 10, and the steering board 11 is rotatably attached to the recessed portion 10*a*.

The rotation sensor 12 that acquires rotation information of the steering board 11 is disposed below the steering board 11. The rotation information acquired by the rotation sensor 12 is supplied to the control unit 14. For example, the rotation information of the steering board 11 is a rotation angle of the steering board 11. In this case, a rotation angle sensor is used as the rotation sensor 12.

The steering board 11 may be configured to generate a torque when the steering board 11 is rotated. In this case, a torque sensor can be used as the rotation sensor 12. That is, in this case, the rotation information of the steering board 11 is acquired by detecting the torque required for rotating the steering board 11 using the torque sensor. For example, by providing the steering board 11 with a spring (not illustrated) to apply a force for returning the steering board to a neutral position, a torque can be generated when the steering board 11 is rotated.

Figure 4:
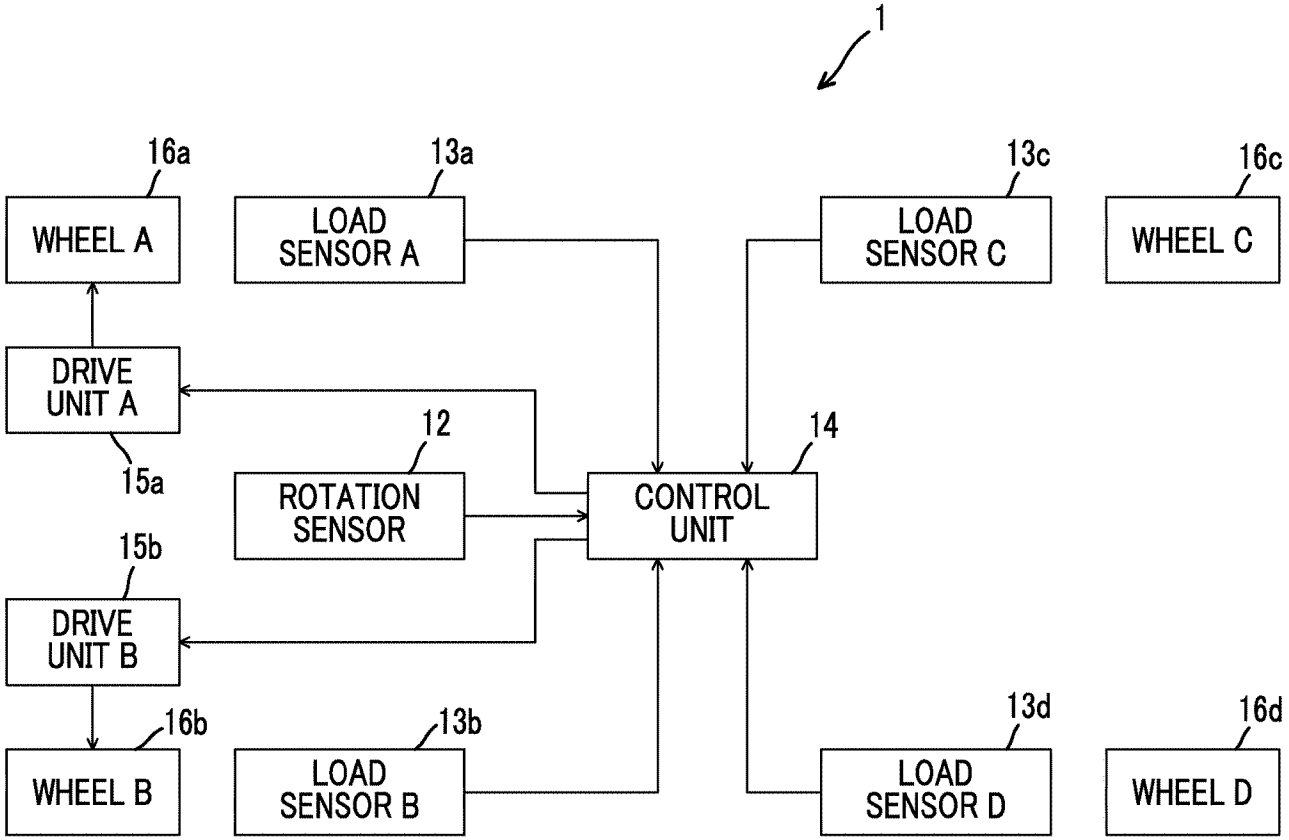
FIG. 4 is a block diagram illustrating a system configuration of the standing-ride type moving device according to the embodiment.

A system configuration of the standing-ride type moving device 1 according to the embodiment will be described below with reference to the block diagram illustrated in FIG. 4. As illustrated in FIG. 4, load information acquired by the load sensors 13*a* to 13*d* is supplied to the control unit 14. The rotation information of the steering board 11 acquired by the rotation sensor 12 is supplied to the control unit 14. The control unit 14 generates control signals for controlling the drive units 15*a* and 15*b* using the information acquired by the load sensors 13*a* to 13*d* and the rotation sensor 12, and supplies the generated control signals to the drive units 15*a* and 15*b*. The drive units 15*a* and 15*b* rotationally drive the wheels 16*a* and 16*b*, respectively, on the basis of the control signals supplied from the control unit 14.

Specifically, the control unit 14 controls the rotation speeds of the drive units 15*a* and 15*b* depending on the shift in the center of gravity of the rider 30 detected by the load sensors 13*a* to 13*d* to control the speed in the traveling direction of the board 10. The board 10 is turned in a direction corresponding to the rotation information by independently controlling the rotation speeds of the drive unit 15*a* and 15*b* on the basis of the rotation information of the steering board 11 acquired by the rotation sensor 12.

First, operations of accelerating and decelerating the standing-ride type moving device 1 will be described below in detail. The control unit 14 controls the rotation speeds of the drive units 15*a* and 15*b* on the basis of the loads (corresponding to the shift in the center of gravity of a rider) detected by the load sensors 13*a* to 13*d*. Specifically, when the total sum of the loads detected by the load sensors 13*a* and 13*b* disposed on the front side is defined as $W_f$ and the total sum of the loads detected by all the load sensors 13*a* to 13*d* is defined as $W_a$, the acceleration of the board 10 can be expressed by the following equation.

$$Acceleration=(W_f/W_a-0.5)\times k \qquad \text{Equation 1}$$

Here, $W_f/W_a$ represents a ratio of loads applied to the front side. In addition, k is an arbitrary coefficient.

When the total sum of the loads detected by the load sensors 13*a* and 13*b* is equal to the total sum of the loads detected by the load sensors 13*c* and 13*d*, that is, when the center of gravity of the rider is positioned at the center, $W_f/W_a$ is equal to 0.5 and thus the acceleration is zero.

Figure 5:
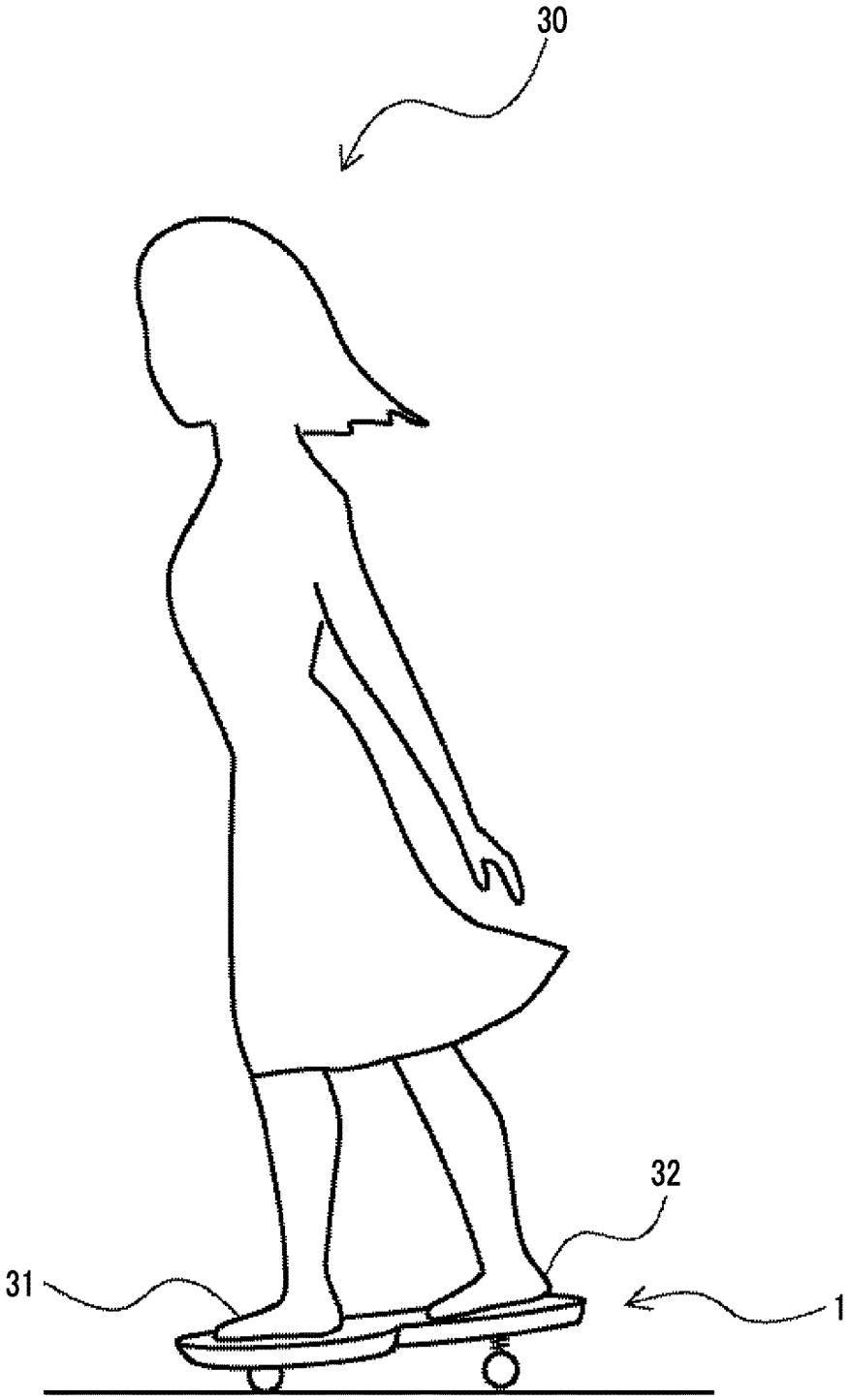
FIG. 5 is a diagram illustrating a control example (acceleration) of the standing-ride type moving device according to the embodiment.
Figure 6:
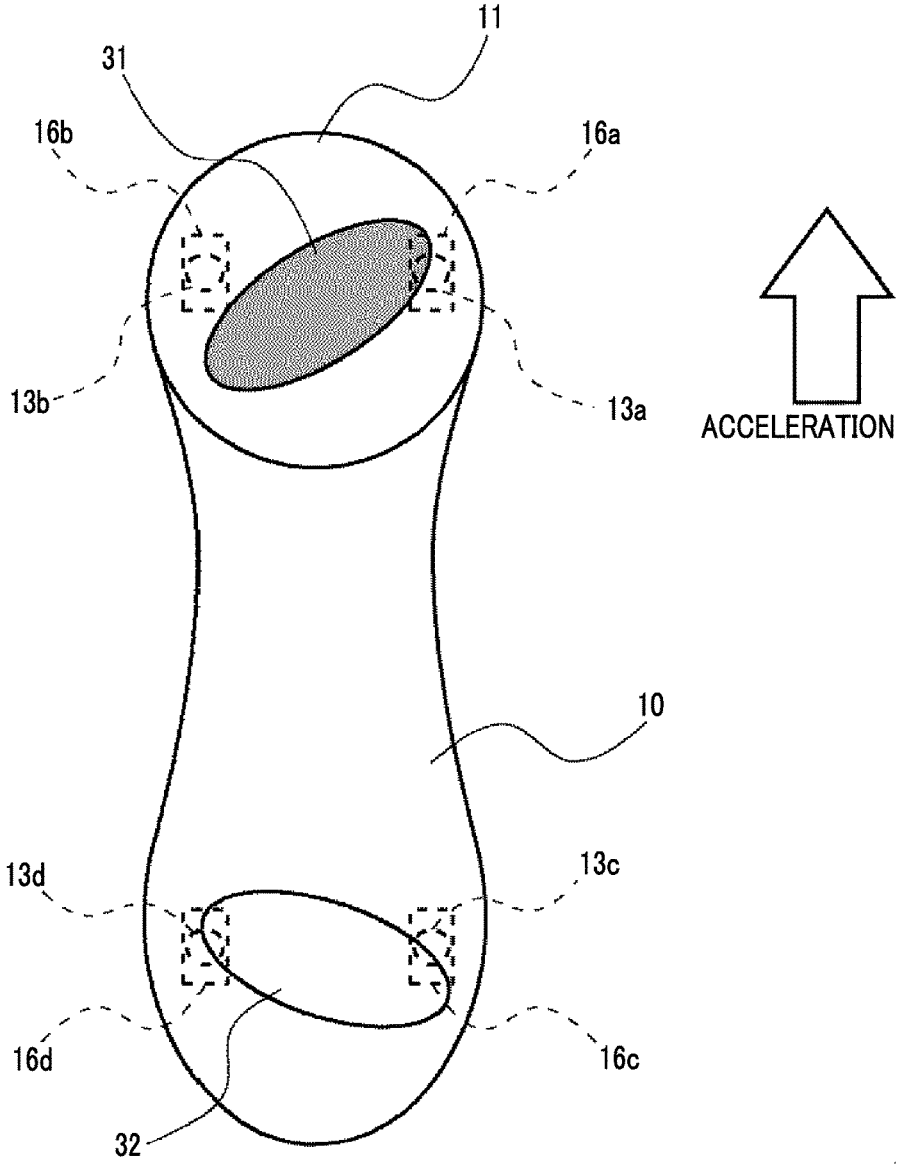
FIG. 6 is a top view illustrating a control example (acceleration) of the standing-ride type moving device according to the embodiment.

When the rider 30 applies more weight with his or her left foot 31 than with his or her right foot 32 as illustrated in FIGS. 5 and 6, the center of gravity of the rider 30 is shifted to the front side in the traveling direction of the board 10. In this case, the total sum of the loads detected by the load sensors 13*a* and 13*b* is larger than the total sum of the loads detected by the load sensors 13*c* and 13*d* and the value of $W_f/W_a$ in Equation 1 is larger than 0.5. Accordingly, the acceleration is changed to a positive value to accelerate the standing-ride type moving device. At this time, the acceleration increases as the value of $W_f$ increases.

Figure 7:
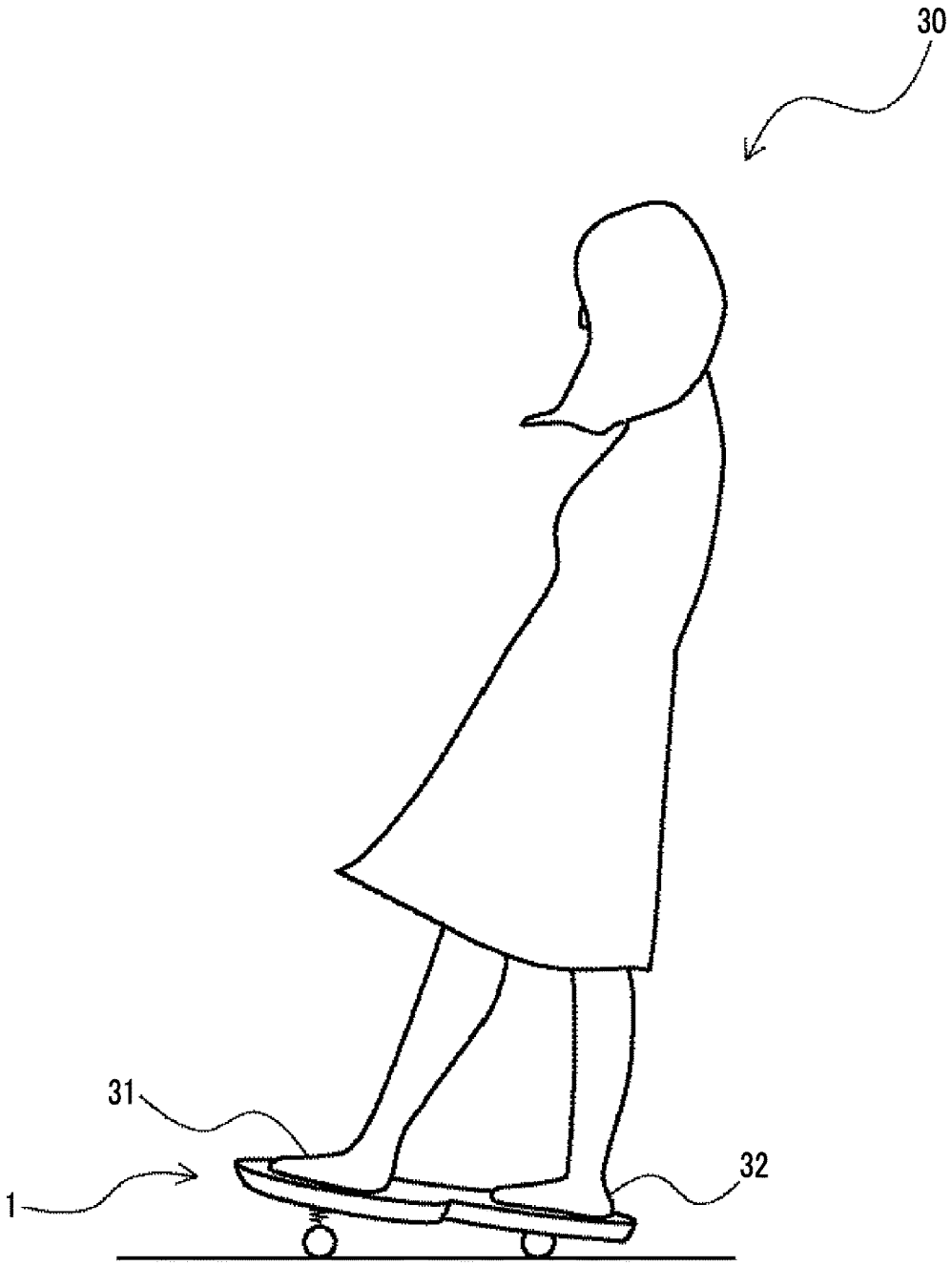
FIG. 7 is a diagram illustrating a control example (deceleration) of the standing-ride type moving device according to the embodiment.
Figure 8:
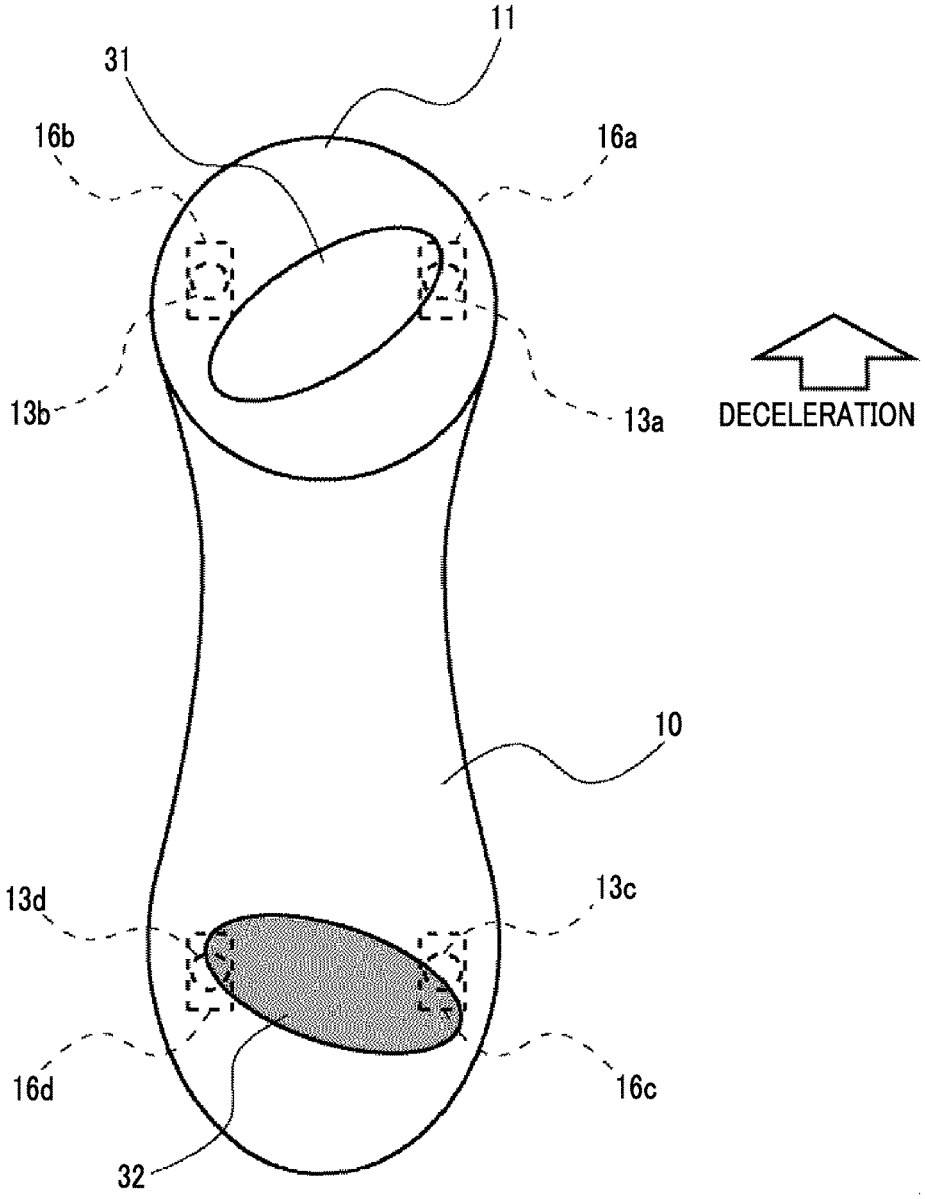
FIG. 8 is a top view illustrating a control example (deceleration) of the standing-ride type moving device according to the embodiment.

When the rider 30 applies more weight with his or her right foot 32 than with his or her left foot 31 as illustrated in FIGS. 7 and 8, the center of gravity of the rider 30 is shifted to the rear side in the traveling direction of the board 10. In this case, the total sum of the loads detected by the load sensors 13*c* and 13*d* is larger than the total sum of the loads detected by the load sensors 13*a* and 13*b* and the value of $W_f/W_a$ in Equation 1 is smaller than 0.5. Accordingly, the acceleration is changed to a negative value to decelerate the standing-ride type moving device. At this time, the acceleration decreases as the value of $W_f$ decreases.

The control unit 14 illustrated in FIG. 4 controls the drive units 15*a* and 15*b* such that the acceleration of the board 10 is equal to the acceleration calculated using Equation 1. For example, the control unit 14 determines target rotation speeds of the drive units 15*a* and 15*b* using the acceleration calculated in Equation 1 and controls the drive units 15*a* and 15*b* such that the rotation speeds of the drive units 15*a* and 15*b* are equal to the target rotation speeds. The rotation speeds of the drive units 15*a* and 15*b* correspond to the rotation speeds of the wheels 16*a* and 16*b*.

The operation of turning the standing-ride type moving device 1 will be described below in detail. The control unit 14 illustrated in FIG. 4 independently controls the rotation speeds of the drive units 15*a* and 15*b* on the basis of the rotation information of the steering board 11 (that is, the rotation direction and the rotation angle from the neutral position) acquired by the rotation sensor 12 to turn the board 10 in the direction corresponding to the rotation information.

Figure 9:
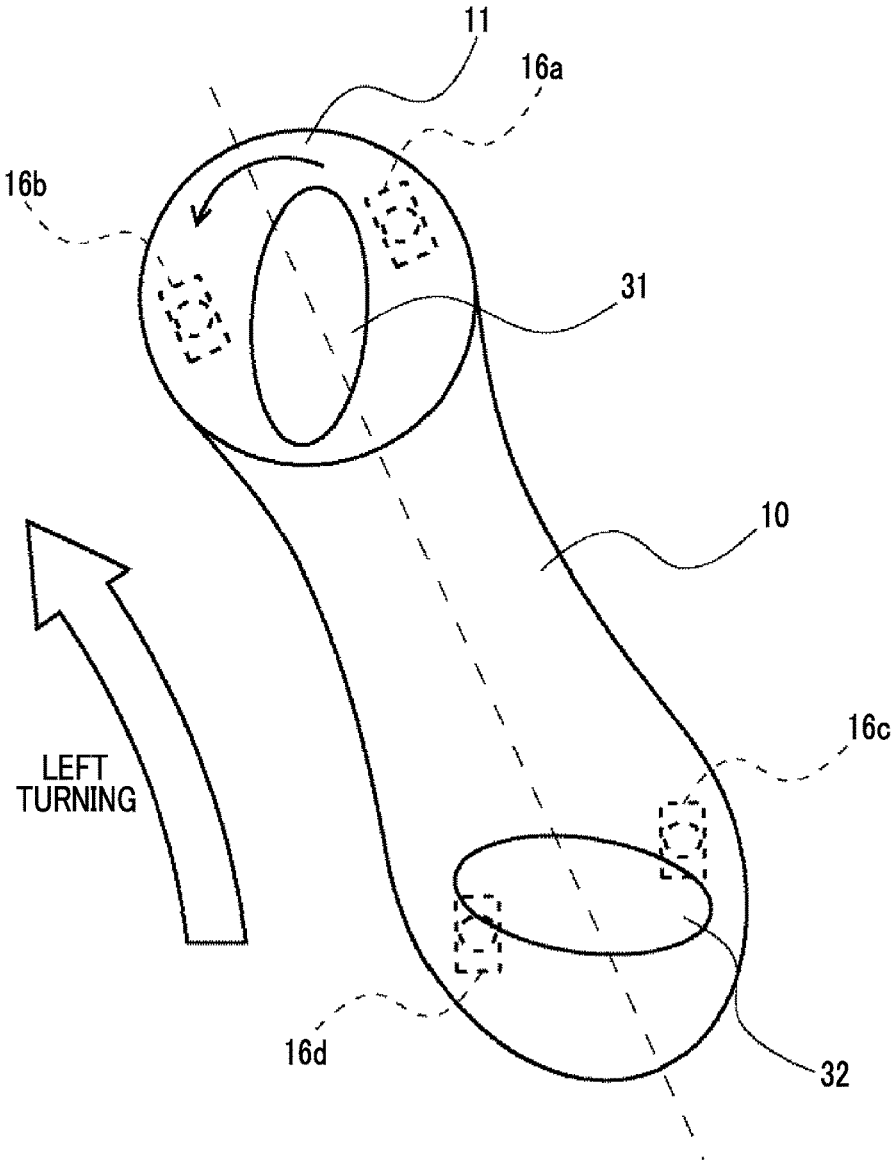
FIG. 9 is a top view illustrating a control example (left turning) of the standing-ride type moving device according to the embodiment.

Specifically, when the rotation direction of the steering board 11 operated by the rider with his or her left foot 31 is a leftward direction as illustrated in FIG. 9, the control unit 14 sets the rotation speed of the drive unit 15*a* (the wheel 16*a*) disposed on the right side in the traveling direction of the board 10 to be higher than the rotation speed of the drive unit 15*b* (the wheel 16*b*) disposed on the left side in the traveling direction of the board 10. Accordingly, the board 10 is turned left. The turning quantity at this time is determined depending on the rotation angle of the steering board 11. That is, the turning quantity of the board 10 increases as the rotation angle of the steering board 11 increases.

Figure 10:
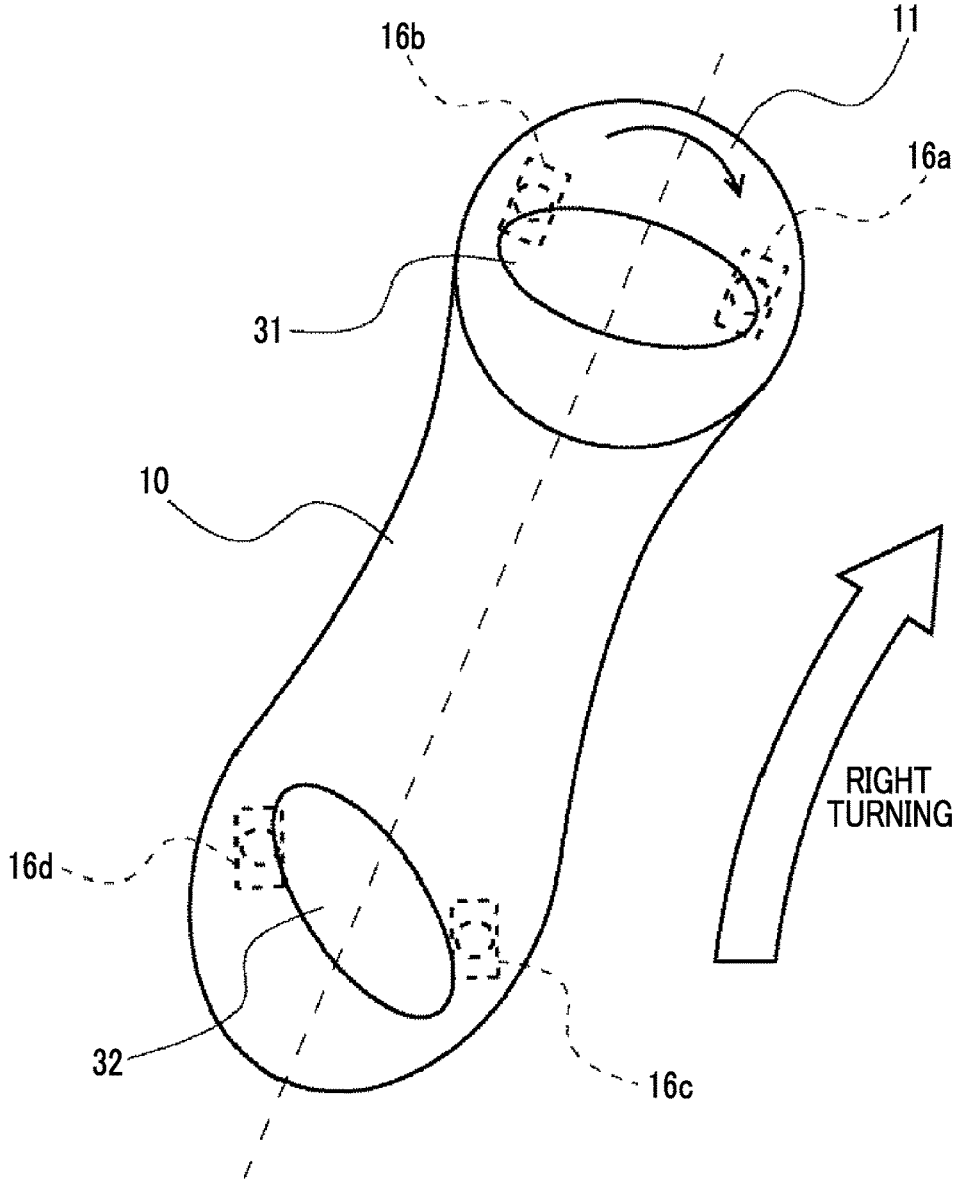
FIG. 10 is a top view illustrating a control example (right turning) of the standing-ride type moving device according to the embodiment.

Specifically, when the rotation direction of the steering board 11 operated by the rider with his or her left foot 31 is a rightward direction as illustrated in FIG. 10, the control unit 14 sets the rotation speed of the drive unit 15*b* (the wheel 16*b*) disposed on the left side in the traveling direction of the board 10 to be higher than the rotation speed of the drive unit 15*a* (the wheel 16*a*) disposed on the right side in the traveling direction of the board 10. Accordingly, the board 10 is turned right. The turning quantity at this time is determined depending on the rotation angle of the steering board 11. That is, the turning quantity of the board 10 increases as the rotation angle of the steering board 11 increases.

Specifically, when a rotation angle in the clockwise direction of the steering board 11 is defined as θ (rad) and a turning gain thereof is defined as $k_1$ (1/s), the rotation speed $\omega_R$ (rad/s) of the drive unit 15*a* (on the right side) and the rotation speed $\omega_L$ (rad/s) of the drive unit 15*b* (on the left side) can be expressed by Equations 2 and 3.

$$\omega_R=\omega-k_1\omega\theta \quad \text{Equation 2}$$

$$\omega_L=\omega+k_1\omega\theta \quad \text{Equation 3}$$

Here, ω (rad/s) represents the rotation speed of the drive units 15*a* and 15*b* when the steering board 11 is not turned, that is, moves straight.

When the gap between the right and left wheels is defined as 2D (m), the turning radius R (m) at the time of turning can be expressed by the following equation.

$$R=D/(k_1\cdot\theta) \quad \text{Equation 4}$$

(θ≠0 )

In this case, as expressed by Equation 4, the turning radius R at the time of turning is determined depending on only the rotation angle θ of the steering board 11 (that is, the only variable in Equation 4 is θ). That is, since the turning quantity (corresponding to the turning radius R) of the board 10 varies linearly with respect to the rotation angle θ of the steering board 11, the rider can intuitively turn the board 10 in a predetermined direction. The board is turned to right when R has a positive value, and the board is turned to left when R has a negative value.

In the standing-ride type moving device 1 according to the embodiment, the control unit 14 may control the drive units 15*a* and 15*b* such that the turning radius of the board 10 in which the board is turned increases as the rotation speeds of the drive units 15*a* and 15*b* increase (that is, as the speed of the board 10 increases). In other words, the control unit 14 may control the drive units 15*a* and 15*b* such that the turning quantity of the board 10 with respect to the rotation angle of the steering board 11 decreases as the rotation speeds of the drive units 15*a* and 15*b* increase.

Specifically, when a rotation angle in the clockwise direction of the steering board 11 is defined as θ (rad) and a turning gain thereof is defined as $k_2$ (1/s), the rotation speed $\omega_R$ (rad/s) of the drive unit 15*a* (on the right side) and the rotation speed $\omega_L$ (rad/s) of the drive unit 15*b* (on the left side) can be expressed by Equations 5 and 6.

$$\omega_R=\omega-k_2\omega\theta \quad \text{Equation 5}$$

$$\omega_L=\omega+k_2\omega\theta \quad \text{Equation 6}$$

Here, ω (rad/s) represents the rotation speeds of the drive units 15*a* and 15*b* when the steering board 11 is not turned, that is, moves straight.

When the gap between the right and left wheels is defined as 2D (m), the turning radius R (m) at the time of turning can be expressed by the following equation.

$$R=D\omega/(k_2\cdot\theta) \quad \text{Equation 7}$$

(θ≠0)

In this case, as expressed by Equation 7, the turning radius R at the time of turning is determined depending on the rotation angle θ of the steering board 11 and the rotation speeds ω of the drive units 15*a* and 15*b* at the time of moving straight. That is, the turning radius R increases as the rotation speeds ω of the drive units 15*a* and 15*b* at the time of moving straight increase. Accordingly, the turning radius of the board 10 in which the board is turned increases as the speed of the board 10 increases. Accordingly, it is possible to prevent the rider from being shaken off the board 10 due to the centrifugal force at the time of turning.

In the standing-ride type moving device 1 according to the embodiment, the control using Equations 2 to 4 and the control using Equations 5 to 7 may be combined. That is, the drive units 15*a* and 15*b* are controlled using Equations 2 to 4 (low-speed control) when the rotation speeds ω of the drive units 15*a* and 15*b* at the time of moving straight are lower than a predetermined rotation speed $\omega_0$ (when moving at a low speed), and the drive units 15*a* and 15*b* may be controlled using Equations 5 to 7 (high-speed control) when the rotation speeds ω of the drive units 15*a* and 15*b* at the time of moving straight are equal to or higher than the predetermined rotation speed $\omega_0$ (when moving at a high speed).

That is, during movement at a low speed ($\omega<\omega_0$), since the turning quantity (corresponding to the turning radius R) of the board 10 varies linearly with respect to the rotation angle θ of the steering board 11 as expressed by Equation 4, the rider can intuitively operate the turning direction of the board 10. On the other hand, during movement at a high speed ($\omega_0\leq\omega$), the turning radius R increases as the rotation speeds ω of the drive units 15*a* and 15*b* increase as expressed by Equation 7. Accordingly, it is possible to prevent the rider from being shaken off the board 10 due to the centrifugal force at the time of turning. The value of $w_o$ can be arbitrarily determined.

When the low-speed control and the high-speed control are combined, the turning gain $k_1$ and the turning gain $k_2$ need to satisfy Equation 8 such that the low-speed control and the high-speed control are continuously switched.

$$k_2=k_1\omega_0 \quad \text{Equation 8}$$

An example in which the drive units 15*a* and 15*b* are controlled using the rotation angle θ of the steering board 11 was described above, but the same control can be carried out in the standing-ride type moving device 1 according to the embodiment in which a torque sensor is used as the rotation sensor 12. That is, when a torque sensor is used as the rotation sensor 12, the drive units 15*a* and 15*b* are controlled in the same way using a torque T (Nm) of the steering board 11 acquired by the torque sensor and the turning gains $k_3$ and $k_4$ (Nms). At this time, θ in the equations is replaced with T and the turning gains $k_1$ and $k_2$ (1/s) are replaced with the turning gains $k_3$ and $k_4$ (Nms), respectively.

In the self-propelled roller board disclosed in JP H9-010375 A, the traveling direction of the self-propelled roller board is changed by a rider rotating the turning control board disposed on the front side of the self-propelled roller board with his or her feet to change the direction of the front wheels. However, in the self-propelled roller board disclosed in JP H9-010375 A, since the wheels are mechanically connected to the turning control board, a level difference or an inclination of a road surface is transmitted to the rider's feet via the wheels and the turning control board. Accordingly, there is concern of the rider of the self-propelled roller board losing body balance. For example, when the self-propelled roller board travels on a rough road, resistance between the road surface and the wheels increases and thus the turning control board becomes heavy when the rider rotates the turning control board. Accordingly, there is a possibility of the rider losing body balance and having an unstable posture when the rider rotates the turning control board.

On the other hand, in the standing-ride type moving device 1 according to the embodiment, the board 10 is turned in the direction corresponding to the rotation information by independently controlling the rotation speeds of the drive units 15*a* and 15*b* on the basis of the rotation information of the steering board 11 acquired by the rotation sensor 12. In the standing-ride type moving device 1 according to the embodiment having this configuration, since the steering board 11 and the wheels 16*a* and 16*b* are not mechanically connected to each other, it is possible to prevent a level difference or an inclination of a road surface from being transmitted to the rider's feet. Since the rotation information of the steering board 11 is acquired using the rotation sensor 12 and the drive units 15*a* and 15*b* are controlled using the rotation information, the steering board 11 does not become heavy even during travel on a rough road. Accordingly, it is possible to prevent the rider from losing body balance. As a result, it is possible to provide a standing-ride type moving device that can stabilize a rider's posture.

An example in which the rider rides with his or her left foot 31 on the front side (see FIG. 2) was described above, but the rider may ride with his or her right foot on the front side. In this case, the left foot and the right foot in the above description are switched.

Figure 11:
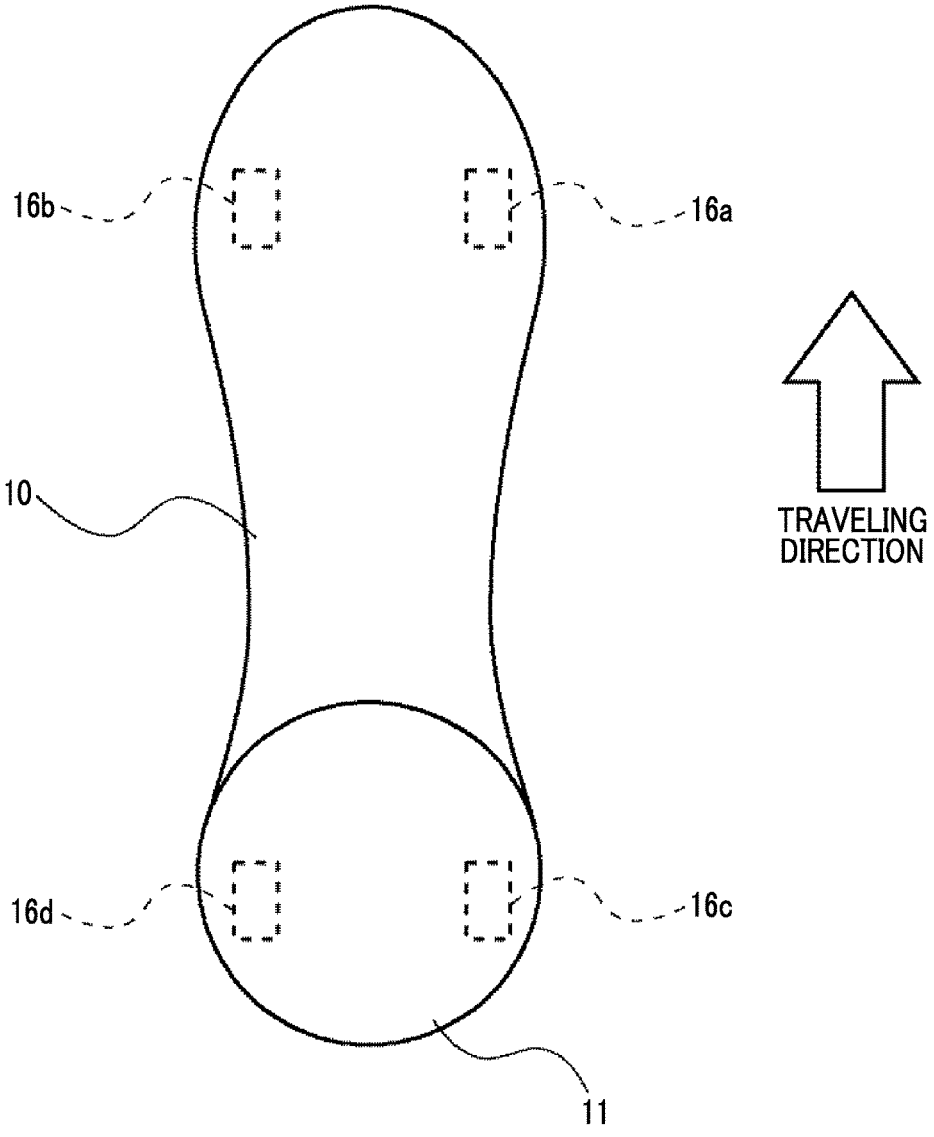
FIG. 11 is a top view illustrating another example of the configuration of the standing-ride type moving device according to the embodiment.

An example in which the steering board 11 is disposed on the front side in the traveling direction of the board 10 (see FIG. 1) was described above. However, in the standing-ride type moving device 1 according to the embodiment, the steering board 11 can be disposed on any one of the front side and the rear side in the traveling direction of the board 10. For example, as illustrated in FIG. 11, the steering board 11 may be disposed on the rear side in the traveling direction of the board 10.

An example in which the front wheels 16*a* and 16*b* are provided with the drive units 15*a* and 15*b*, respectively, (see FIG. 3) was described above. However, in the standing-ride type moving device 1 according to the embodiment, the drive units can be disposed in the wheels disposed on the right and left sides of at least one of the front side and the rear side in the traveling direction of the board, and for example, the rear wheels 16*c* and 16*d* may be provided with the drive units, respectively. All the wheels 16*a* to 16*d* may be provided with the drive units. An example in which casters are used as the rear wheels 16*c* and 16*d* (see FIG. 3) was described above, but omnidirectional wheels may be used as the wheels 16*c* and 16*d*.

Figure 12:
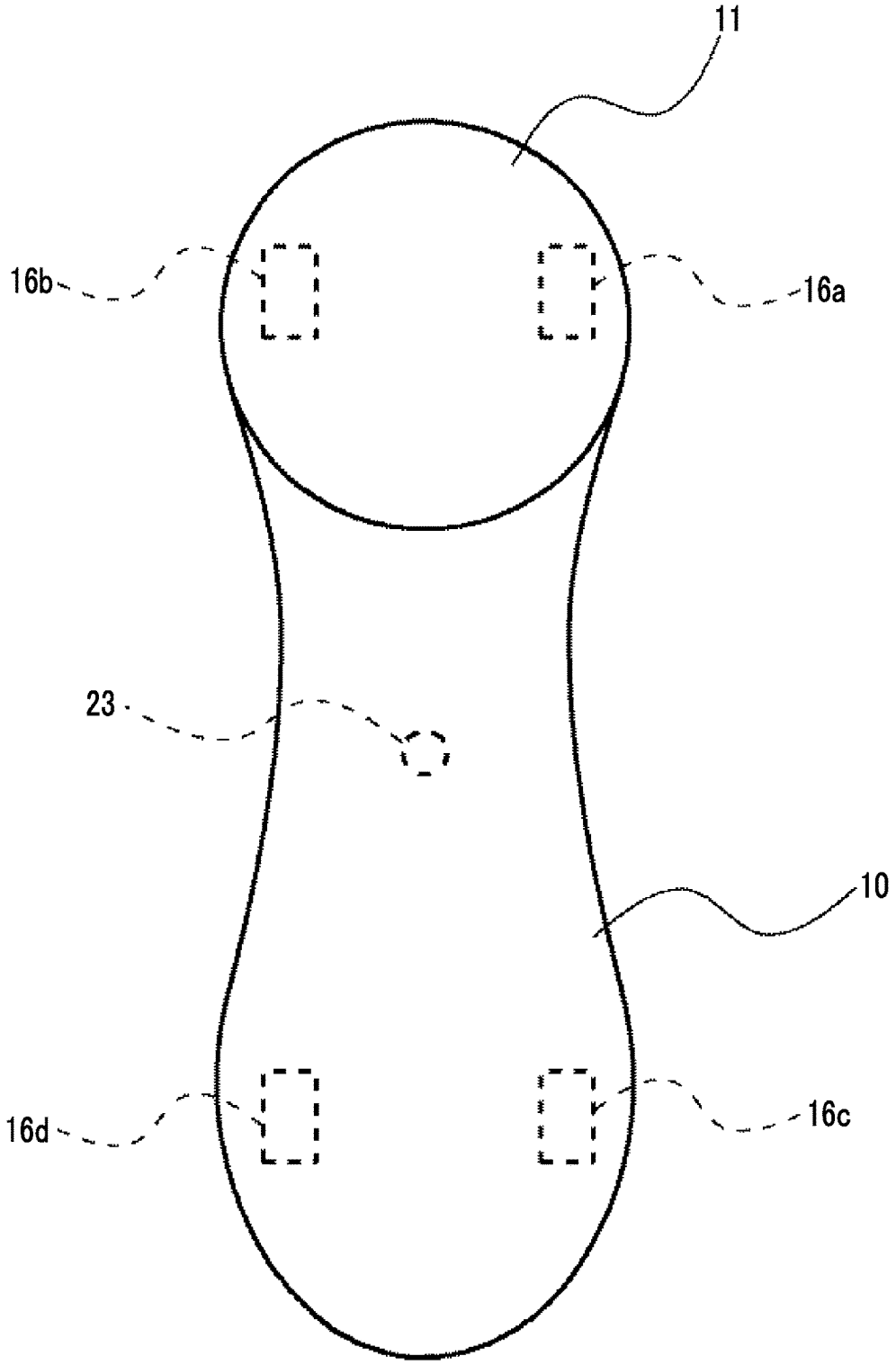
FIG. 12 is a top view illustrating another example of the configuration of the standing-ride type moving device according to the embodiment.
Figure 13:
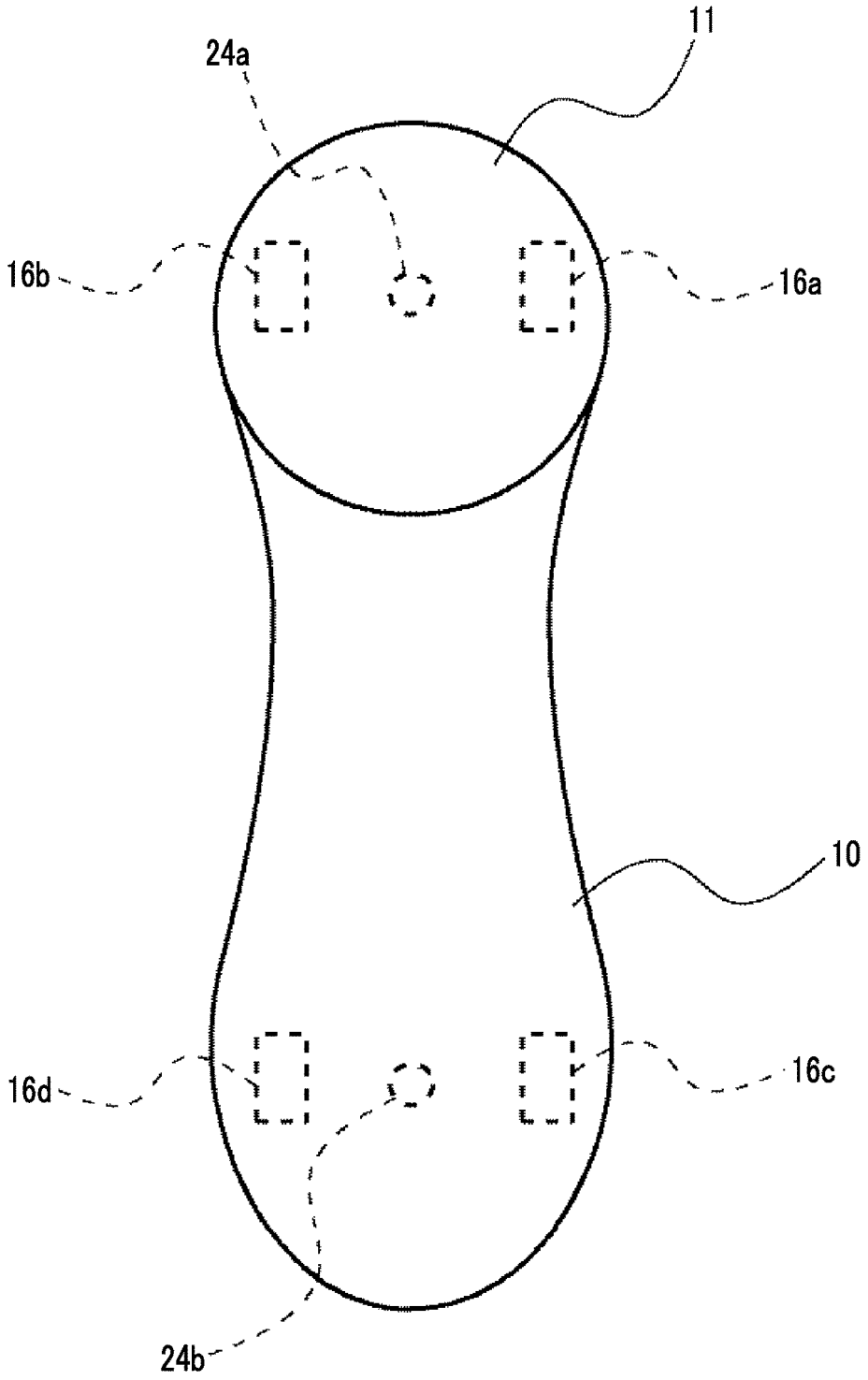
FIG. 13 is a top view illustrating another example of the configuration of the standing-ride type moving device according to the embodiment.

An example in which the shift in the center of gravity (weight shift) of the rider is detected using four load sensors 13*a* to 13*d* (see FIG. 3) was described above. However, in the standing-ride type moving device 1 according to the embodiment, a single multiaxial sensor 23 may be disposed at the center of the board 10 as illustrated in FIG. 12. The multiaxial sensor 23 can be constituted, for example, using a force sensor that detects distortion in multiaxial directions (for example, three axial directions). When a triaxial force sensor is used, a force vector varies in the front-rear direction with the variation in position of the rider's load in the front-rear direction and thus the shift in the center of gravity can be detected. As illustrated in FIG. 13, load sensors 24*a* and 24*b* may be disposed on the front side and the rear side of the board 10, respectively.

While the disclosure has been described above with reference to the embodiment, the disclosure is not limited to the configuration of the embodiment but includes various modifications, corrections, and combinations which can be made by those skilled in the art within the scope of the disclosure described in the appended claims.

What is claimed is:

1. A standing-ride type moving device comprising:

a board that a rider rides;

wheels that are disposed on right and left sides of a front side and a rear side in a traveling direction of the board;

a first drive unit that is configured to independently rotationally drive the wheel disposed on the right side in the traveling direction of the board on at least one of the front side and the rear side in the traveling direction of the board;

a second drive unit that is configured to independently rotationally drive the wheel disposed on the left side in the traveling direction of the board to correspond to the wheel rotationally driven by the first drive unit;

a first sensor that is configured to detect a shift in a center of gravity of the rider riding the board;

a steering board that is disposed on at least one of the front side and the rear side in the traveling direction of the board and is rotatable about a rotational axis extending in a vertical direction;

a second sensor that is configured to acquire rotation information of the steering board; and a control unit that is configured to control the first and second drive units, wherein the control unit controls rotation speeds of the first and second drive units based on the shift in the center of gravity of the rider detected by the first sensor to control a speed in the traveling direction of the board and turns the board in a direction corresponding to the rotation information by independently controlling the rotation speeds of the first and second drive units based on the rotation information acquired by the second sensor.

2. The standing-ride type moving device according to claim 1, wherein the control unit controls the first and second drive units such that a turning radius of the board in which the board is turned increases as the rotation speeds of the first and second drive units increase.

3. The standing-ride type moving device according to claim 1, wherein the control unit controls the first and second drive units such that a turning radius of the board in which the board is turned decreases as the rotation speeds of the first and second drive units decrease.

4. The standing-ride type moving device according to claim 1, wherein the control unit controls the first and second drive units such that a turning radius of the board in which the board is turned varies linearly with respect to the rotation information of the steering board acquired by the second sensor when the rotation speeds of the first and second drive units are lower than a predetermined rotation speed.

5. The standing-ride type moving device according to claim 1, further comprising a rectangular frame that is disposed between the board and the wheels, wherein the first sensor is disposed at four corners of the frame to be interposed between the frame and the board.

6. The standing-ride type moving device according to claim 1, wherein the board includes a recessed portion in which the steering board is rotatably disposed.

7. The standing-ride type moving device according to claim 1, wherein the second sensor is a rotation angle sensor.

8. The standing-ride type moving device according to claim 1, wherein the second sensor is a torque sensor.

9. The standing-ride type moving device according to claim 1, wherein the first sensor is a multiaxial sensor that is disposed at a center of the board.

* * * * *